US006050170A

United States Patent [19]

Guiette, III et al.

[11] Patent Number: 6,050,170

[45] Date of Patent: Apr. 18, 2000

[54] COMBINATION ANTI-ROTATION AND COUNTER-RECOIL DEVICE FOR A SUB-CALIBER BARREL POSITIONED INSIDE A LARGER CALIBER GUN BARREL

[75] Inventors: William E. Guiette, III, Santee, Calif.; John J. Walentine, Calabash, N.C.

[73] Assignee: American Apex Corporation, Columbus, Ohio

[21] Appl. No.: 09/032,987

[22] Filed: Mar. 2, 1998

[51] Int. Cl.[7] ..... F41A 21/10

[52] U.S. Cl. ..... 89/29

[58] Field of Search ..... 89/29, 37.04; 42/77

[56] References Cited

U.S. PATENT DOCUMENTS

| | | | |
|---|---|---|---|
| 1,092,763 | 4/1914 | Bourdelles . | |
| 2,482,808 | 9/1949 | Summerbell | 89/29 |
| 3,771,415 | 11/1973 | Into et al. | 89/16 |
| 5,415,074 | 5/1995 | Fields | 89/29 |

FOREIGN PATENT DOCUMENTS

| | | | |
|---|---|---|---|
| 1002694 | 3/1952 | France | 89/29 |
| 8501341 | 3/1985 | WIPO | 89/29 |

*Primary Examiner*—Stephen M. Johnson
*Attorney, Agent, or Firm*—John L. Gray; Kegler, Brown, Hill & Ritter, LPA

[57] ABSTRACT

A combination anti-rotation and counter-recoil device for a sub-caliber barrel positioned inside a larger caliber barrel gun which utilizes a plate attached to the flat base of the tubular member simulating the cartridge case within the larger caliber gun and is held in position by two arms preventing rotation of said member and also a spring loaded piston is provided which engages an opening in the plate which provides for counter-recoil force after each firing.

6 Claims, 5 Drawing Sheets

COMBINATION ANTI-ROTATION AND COUNTER-RECOIL DEVICE FOR A SUB-CALIBER BARREL POSITIONED INSIDE A LARGER CALIBER GUN BARREL

BACKGROUND OF THE INVENTION

In connection with training and practice use of larger caliber guns such as field artillery pieces and the main gun on tanks, it is common practice to insert in the barrel of the larger caliber gun, a device that is the size of the shell that would normally be placed inside the larger caliber gun, but instead contains centrally disposed therein, a smaller caliber weapon. Thus, when this weapon is fired, it simulates the direction and accuracy of the larger caliber gun for training and practice purposes but reduces the costs of such armament dramatically.

However, in continuing use of such small caliber weapons a number of problems have arisen. These problems involve the rotation of the smaller caliber mechanism and also the recoil of the device causing it to be moved out of position.

Applicant's invention solves both of these problems.

BRIEF SUMMARY OF THE INVENTION

Applicant has devised an attachment to the sub-caliber weapon which when used in combination with another portion of Applicant's device, prevents rotation of the sub-caliber weapon and holds it in place. Furthermore, Applicant provides for a spring-loaded unit which will result in counter-recoil force to reposition the unit after firing.

It is therefore an object of this invention to provide a mechanism which may be used in conjunction for a sub-caliber weapon positioned inside a larger caliber gun to prevent its rotation and also to provide recoil absorption and counter-recoil force.

This, together with other objects of the invention, will become apparent from the following detailed description of the invention and the accompanying drawings.

DETAILED DESCRIPTION OF THE INVENTION

Figure 1:
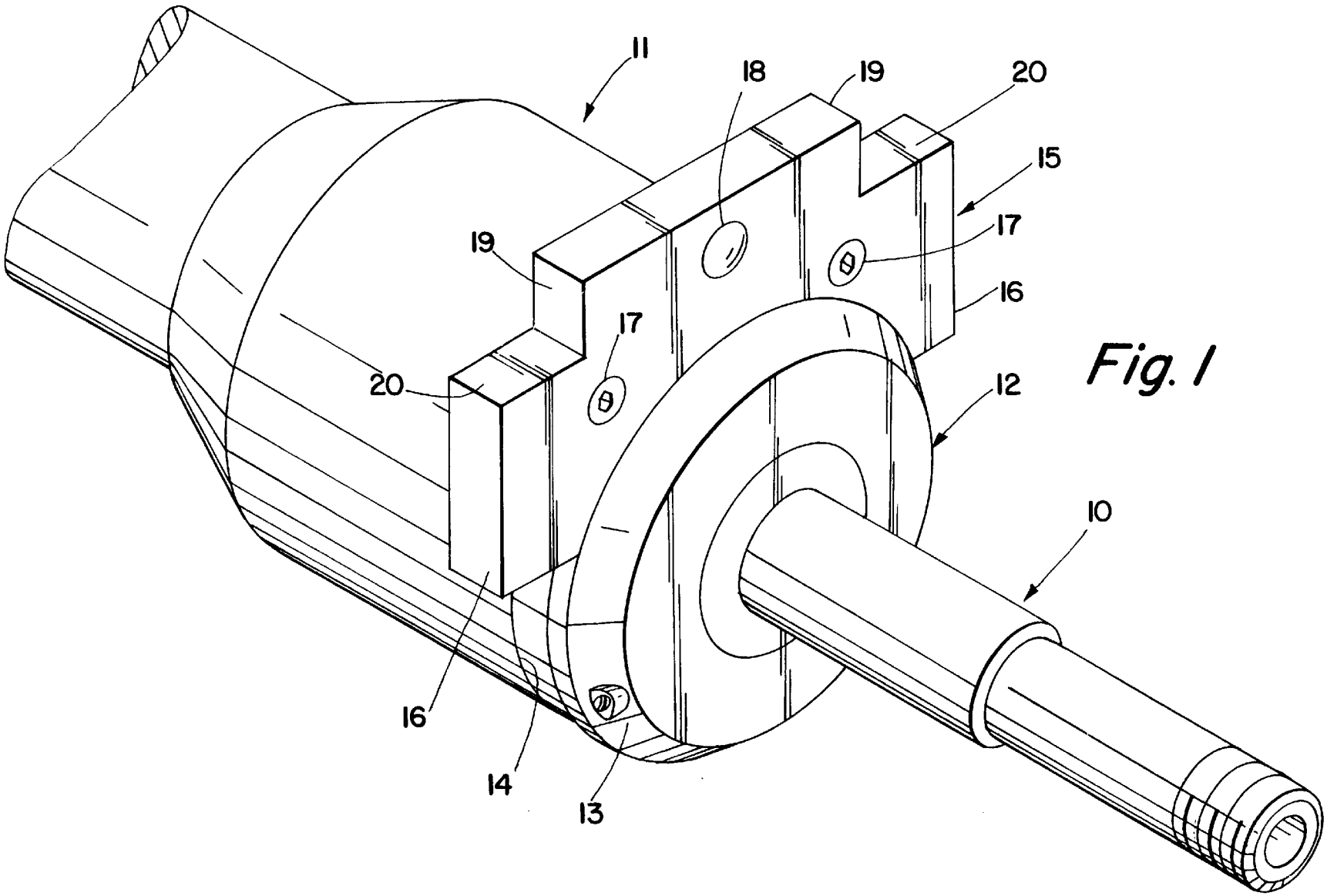
FIG. 1 is a perspective view of a sub-caliber weapon provided with an attachment used in connection with 120 mm caliber guns and above.

Referring now to FIG. 1, the sub-caliber weapon's barrel is shown at 10, positioned inside the tubular member 11 simulating the cartridge case of the larger caliber gun. The sub-caliber weapon 10 normally has a circular conical plate 12 threadedly connected to the shaft of the sub-caliber weapon 10 and which may be held in place by means of a screw 13. Placed above it on the flat base 14 of the tubular member 11 is a flat plate 15 having oppositely disposed parallel sides 16—16 is connected to the base 14 of the tubular member 11 simulating the cartridge case by means of screws 17—17. This flat plate 15 is provided with a hole 18 of a size adapted to receive the piston to be later described. In addition to the parallel sides 16—16, this member also has parallel sides 19—19 and horizontally extending portions 20—20 at right angles to the vertically extending sides 19—19. This assembly is utilized in connection with larger caliber guns of 120 mm or larger.

Figure 2:
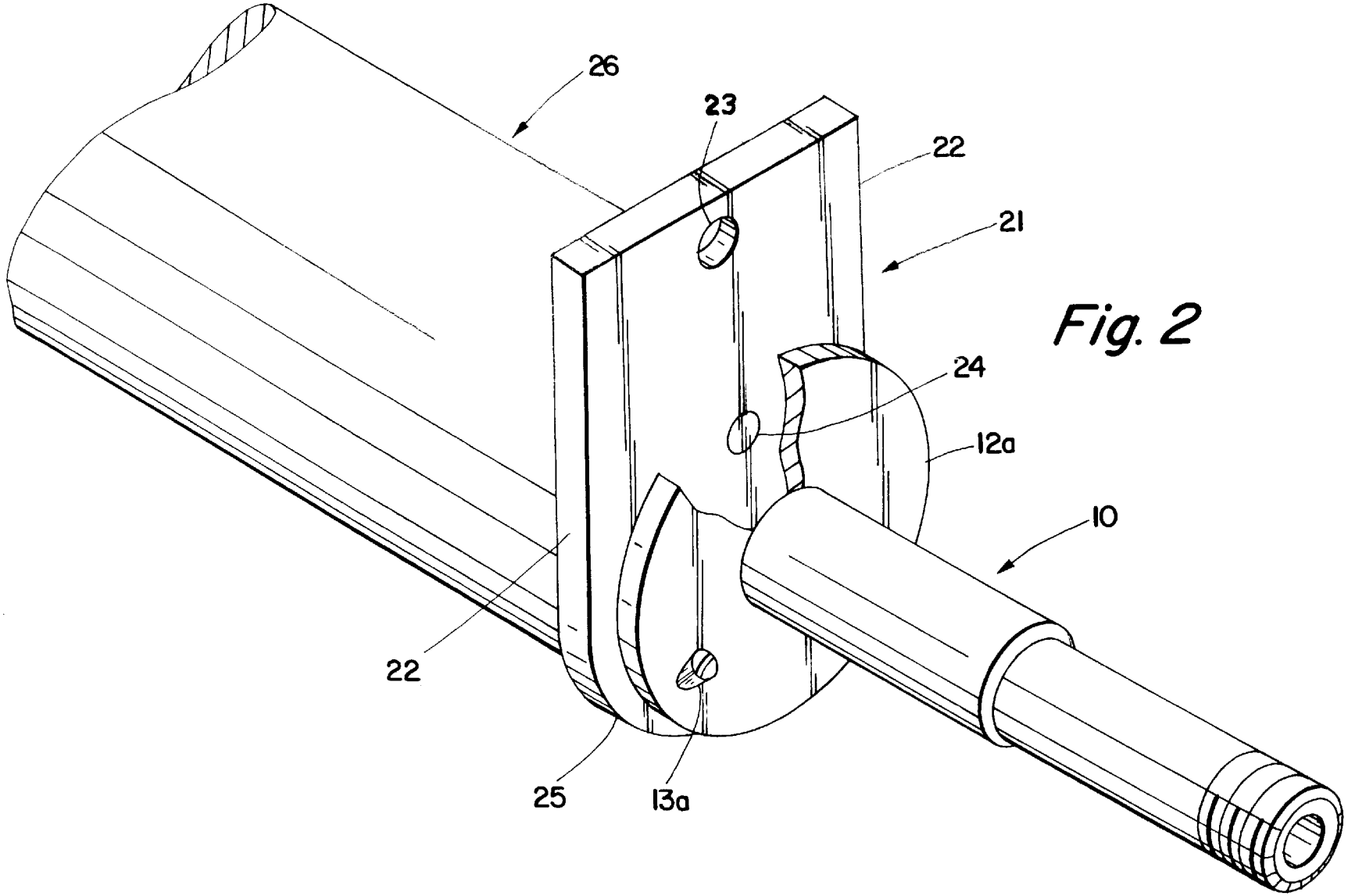
FIG. 2 shows a perspective view of a sub-caliber weapon with an attachment for use in conjunction with guns of 105 mm and smaller.

Referring now to FIG. 2, the sub-caliber weapon barrel 10 is shown and a plate 12A similar to the plate 12 is threadedly positioned on barrel 10 and held in position by screw 13A. This unit is used for large caliber guns of 105 mm or less. The plate 21 in this case has parallel sides 22—22 vertically extending and is provided with an opening 23 of a size to receive a piston to be later described and another opening 24 which permits a pin to be placed against the base 25 of the tubular member 26 to hold the plate 21 in position.

Figure 3:
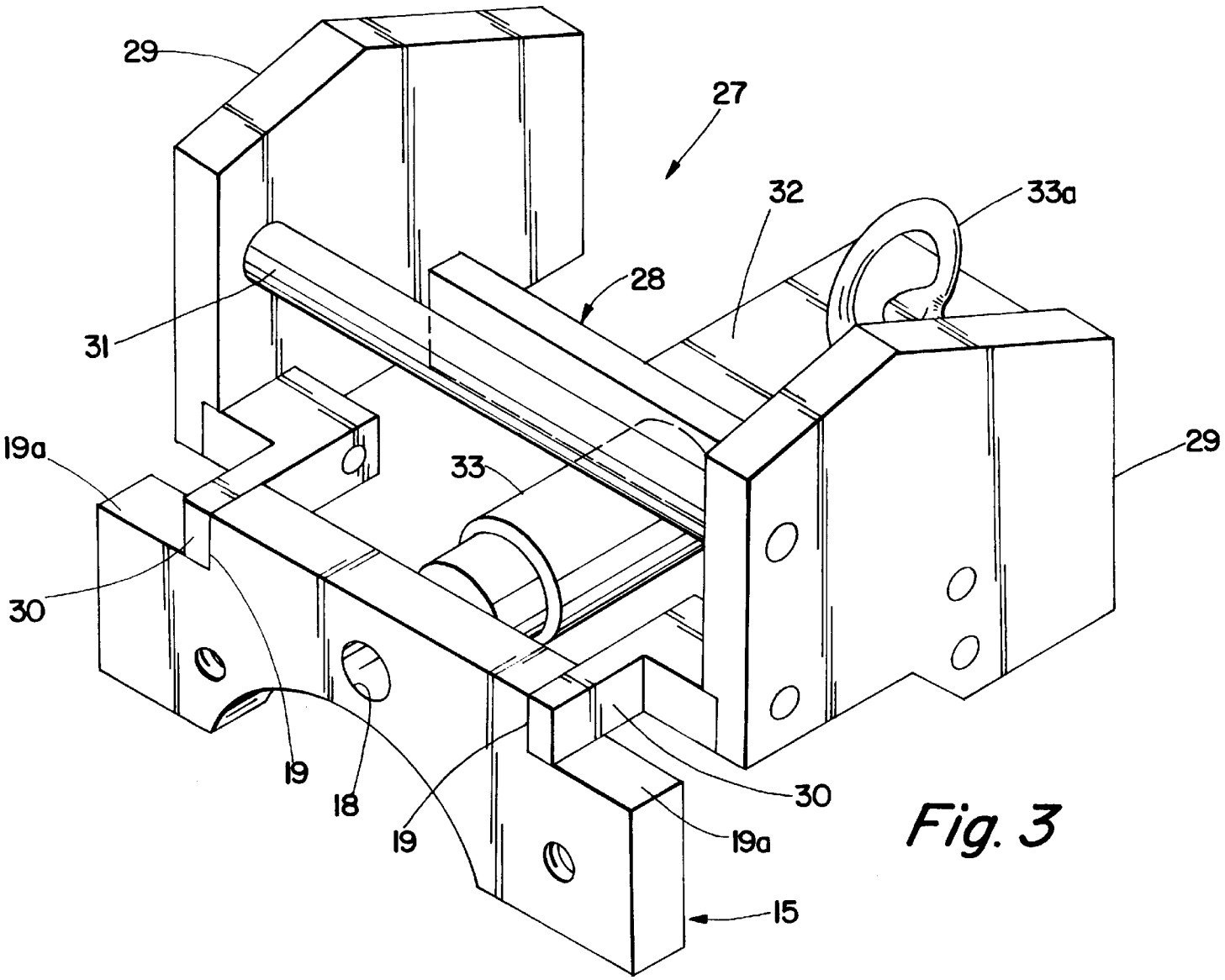
FIG. 3 shows a portion of Applicant's invention positioned in conjunction with the attachment of FIG. 1.

Referring now to FIG. 3, there is shown a U-shaped member which constitute a portion of Applicant's invention shown generally at 27 which is provided with a cross-member 28 connecting oppositely disposed parallel sides 29—29 and forwardly extending arms 30—30. The member 27 is designed and is of such a shape as to fit snugly in the breech block slot of the breech ring of the larger caliber gun. A support handle 31 is included to make it easier to lift the member 27 out of the breech block slot of the larger caliber gun, and support the sides 29—29. The unit 27 is shown in engagement with the member 15 shown in FIG. 1. It will be noted that the fingers 30—30 engage either the oppositely disposed parallel sides 19—19 of member 15 or horizontal surface 19A thus effectively preventing rotation of the sub-caliber weapon 10. The piston cylinder 32 is shown attached to the member 27 with its barrel 33 in line so that the piston (not shown) may engage the opening 18 to lock member 27 to plate 15. The member 27 may also be used in connection with the unit 21 shown in FIG. 2, but in this case the arms 30—30 engage the sides 22—22 of member 21. Cylinder 33 is appropriately positioned so as to engage the opening 23 when the piston in said cylinder 33 is extended.

Figure 4:
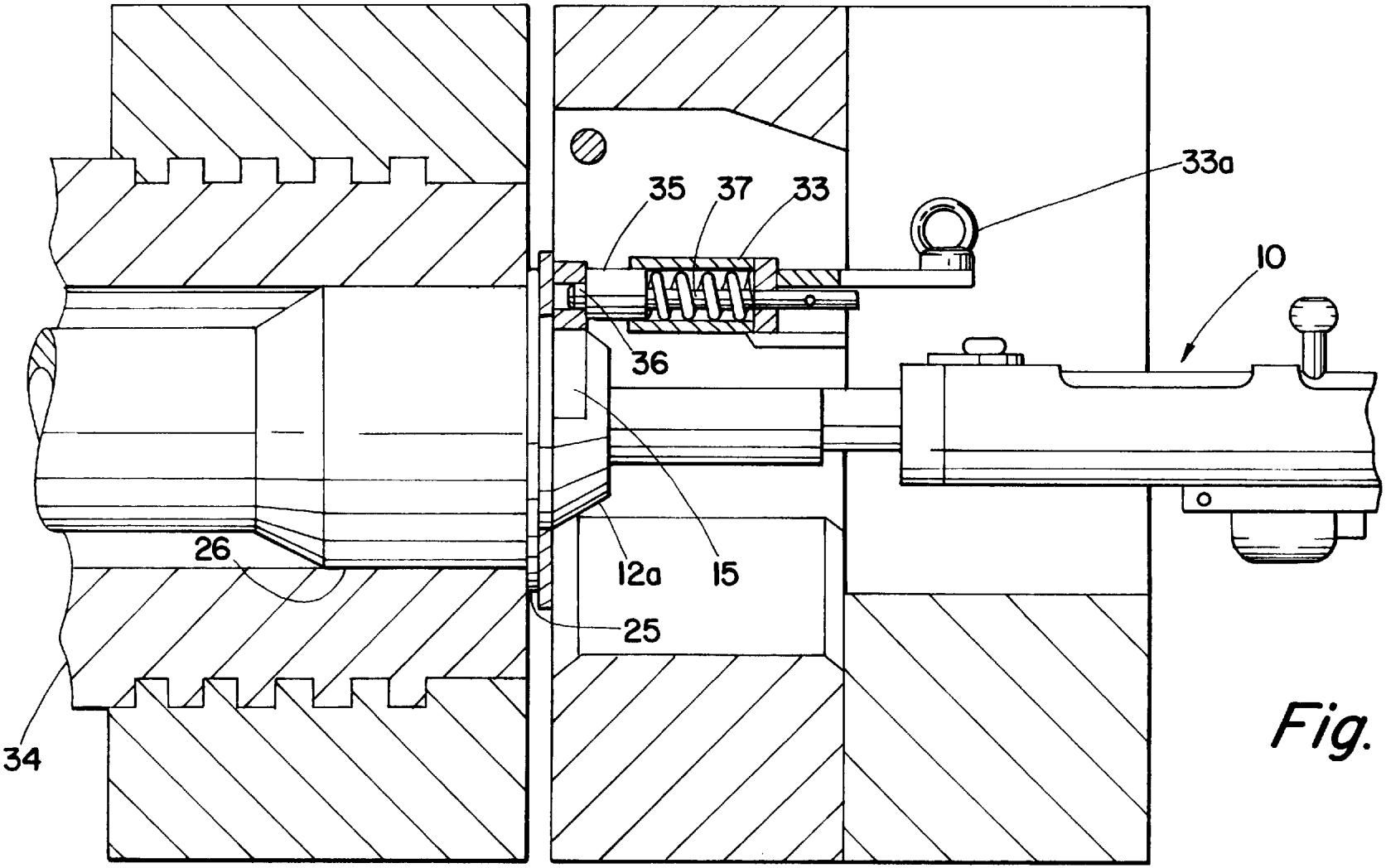
FIG. 4 is a sectional view of FIG. 2 showing the spring-loaded piston engaging the opening of the attachment member shown in FIG. 2.

Referring now to FIG. 4, there is shown a side elevation view in section of Applicant's invention engaged with a larger caliber gun of 120 mm or above as would be used in connection with FIG. 1. The larger caliber barrel is shown at 34 and the tubular member 26 simulating the cartridge case is placed therein. The member 15 is shown adjacent the base 25 of the tubular member 26 simulating cartridge case and held in place by screws 17 (not shown). The cylinder 33 is shown with a lever 33A in position so as to cause the shoulder 35 surrounding the piston 36 to abut against the member 15 with the piston 36 in the opening 18. This also shows the spring 37 inside the cylinder 33. This counters any recoil of the sub-caliber weapon 10.

Figure 5:
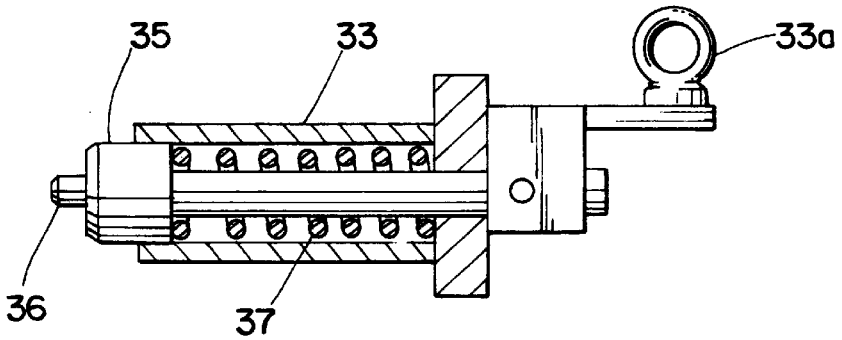
FIG. 5 shows the spring-loaded piston fully extended, before installation in larger caliber gun.
Figure 6:
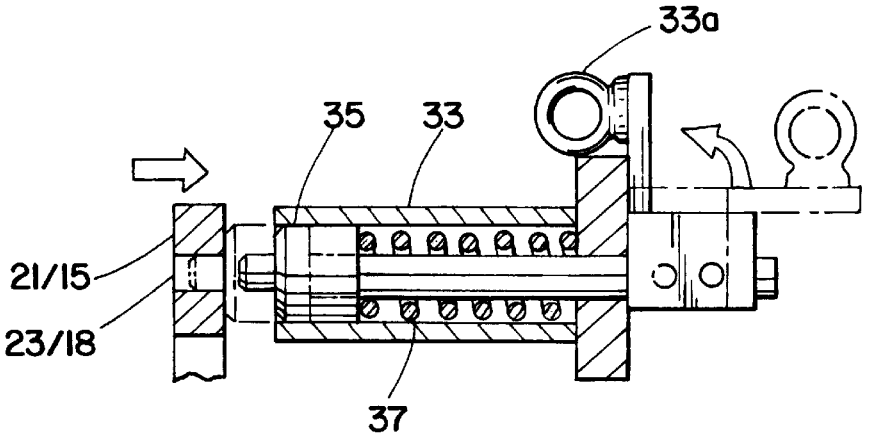
FIG. 6 shows the manner in which the piston may be withdrawn from the opening in the plate shown in FIG. 2 or FIG. 1, for installation and removal.
Figure 7:
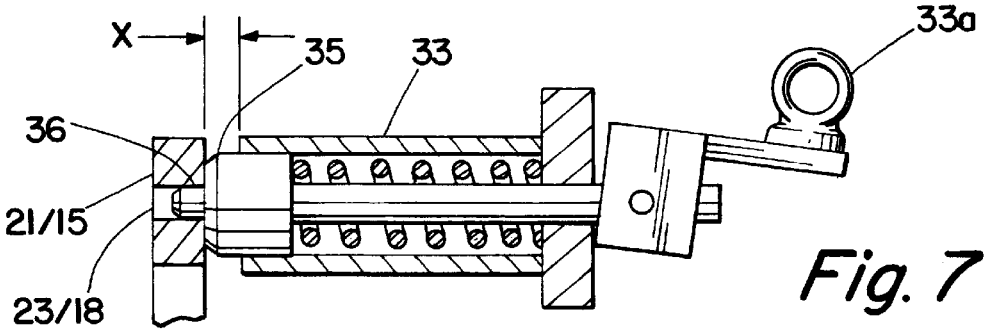
FIG. 7 shows the piston applying force in battery position, i.e., in position of components prior to, and ready for firing, of gun.

Referring now to FIGS. 5, 6 and 7, FIG. 5 shows the piston 36 with the shoulder 35 inside the cylinder 33 in its normal position before installation. FIG. 6 shows the lever 33*a* raised upwardly which causes the shoulder 35 and the piston 36 to compress the spring 37 to permit the unit 27 to be readily installed in or removed from the breech block slot in the breech ring of the larger caliber gun. FIG. 7 shows the cylinder 33 with the piston 36 engaged in the hole 23 or 18 of the plates respectively 21 and 15 with the shoulder 35 abutting there against. The distance X is the distance of the end of cylinder 33 from the back of plates 21 or 15 in the battery position.

Figure 8:
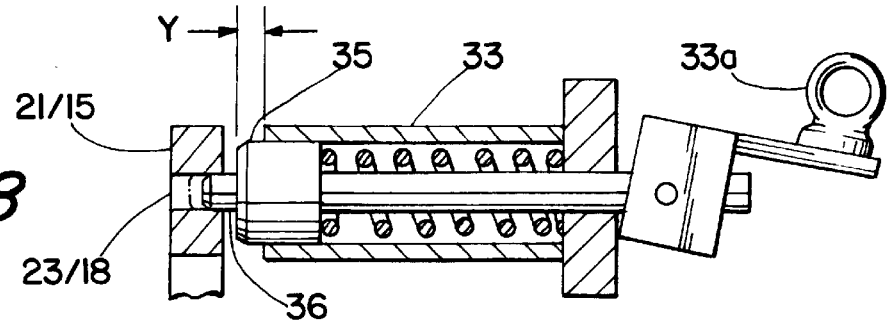
FIG. 8 shows the piston partially pushed back as a result of recoil of the sub-caliber weapon prior to returning it to its proper position.

FIG. 8 shows the piston 36 pushed backwards immediately after firing. The distance Y is the distance of the end of the cylinder 33 from the back of plates 21 or 15 immediately after firing. The distance X-Y is the recoil distance.

In operation the plate 21 is attached to the base 25 of the tubular member 26 simulating the cartridge case of a 105 mm or smaller caliber weapon and the member 15 is attached to the base 25 of a larger caliber gun. The unit 27 is then placed in position in the breech block slot in the breech ring of the large caliber gun with the lever 33*a* in the position shown in FIG. 6. Thereafter the lever 33*a* is moved downwardly so the piston 36 may engage the opening 23 or 18 of the respective plates. Thus, with the two spaced arms engaging either member 15 or 21 preventing rotation thereof and with the piston 36 and the shoulder 35 providing counter-recoil force so as to maintain the sub-caliber weapon 10 in firing position much more efficient and effective use can be obtained.

While this invention has been shown and described with respect to a detailed embodiment thereof, it will be understood by those skilled in the art that various changes in form and detail thereof may be made without departing from the scope of the claims of the invention.

What is claimed is:

1. A combination anti-rotation and counter recoil device for a sub-caliber barrel positioned inside a larger caliber barrel gun which is provided with a tubular member simulating a cartridge case of the size of said larger caliber gun, and provided with a flat base, said tubular member case having the barrel of said sub-caliber weapon centrally positioned therein and extending through said flat base, said combination anti-rotation and counter recoil device comprising:

a flat member having oppositely disposed vertical parallel flat sides, means for attaching said flat member to said flat base of said tubular member, said flat member being provided with a centrally disposed opening in its upper portion, a u-shaped member having a flat base and parallel upstanding sides and of a size to fit snugly in the breech block slot in the breech ring of said larger caliber gun, said u-shaped member having two spaced arms extending forward of said member and so positioned to engage the oppositely disposed parallel sides of said flat member and prevent its rotation, a cylinder attached to said u-shaped member and provided with a piston having a shoulder surrounding said piston and adjacent one end thereof, said piston being biased to extend out of said cylinder by a spring, said piston being so positioned so as to engage the opening in said flat member.

2. The combination anti-rotation and counter-recoil device of claim 1 wherein said flat members oppositely disposed flat sides terminate at essentially right angles with outwardly extending horizontal members.

3. The combination anti-rotation and counter-recoil device of claim 2 wherein said flat member is attached to said flat base of said flat tubular member by means of a pair of screws.

4. The combination anti-rotation and counter-recoil device of claim 1 wherein said flat member is attached to said flat base by means of a pin or screw.

5. The combination anti-rotation and counter-recoil device of claim 1 wherein said piston is of a size to enter the opening in said flat member but is prevented from further movement therethrough by said shoulder surrounding said piston.

6. The combination anti-rotation and counter-recoil device of claim 5 wherein said piston and said cylinder and equipped with a manual control to retract said piston and move it so as to compress its spring.

* * * * *